US008111195B2

(12) United States Patent
Hung et al.

(10) Patent No.: US 8,111,195 B2
(45) Date of Patent: Feb. 7, 2012

(54) MULTI FREQUENCY ANTENNA WITH LOW PROFILE AND IMPROVED GROUNDING ELEMENT

(75) Inventors: Chen-Ta Hung, Tu-cheng (TW); Yun-Lung Ke, Tu-cheng (TW); Shu-Yean Wang, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 552 days.

(21) Appl. No.: 12/283,350

(22) Filed: Sep. 10, 2008

(65) Prior Publication Data

US 2009/0066583 A1 Mar. 12, 2009

(30) Foreign Application Priority Data

Sep. 10, 2007 (TW) ..... 96133661 A

(51) Int. Cl.
*H01Q 1/38* (2006.01)

(52) U.S. Cl. ..... 343/700 MS; 343/702; 343/824; 343/845

(58) Field of Classification Search ..... 343/700 MS, 343/702, 824, 845
See application file for complete search history.

(56) References Cited

U.S. PATENT DOCUMENTS 5,999,132 A * 12/1999 Kitchener et al. ..... 343/702
6,195,048 B1 * 2/2001 Chiba et al. ..... 343/700 MS
6,429,818 B1 * 8/2002 Johnson et al. ..... 343/702
6,861,986 B2 3/2005 Fang
7,148,849 B2 * 12/2006 Lin ..... 343/700 MS
7,154,443 B2 * 12/2006 Inaba et al. ..... 343/702
7,362,277 B2 * 4/2008 Su ..... 343/702
7,466,272 B1 * 12/2008 Su et al. ..... 343/700 MS
7,586,448 B2 * 9/2009 Wei ..... 343/702
7,602,341 B2 * 10/2009 Wei-Shan et al. ..... 343/700 MS
2005/0190108 A1 9/2005 Lin
2006/0250309 A1 11/2006 Fang
2007/0109200 A1 * 5/2007 Su ..... 343/700 MS

FOREIGN PATENT DOCUMENTS

CN 2609205 Y 3/2004
CN 2706884 6/2005
TW I254493 5/2006

* cited by examiner

*Primary Examiner* — Jacob Y Choi
*Assistant Examiner* — Amal Patel
(74) *Attorney, Agent, or Firm* — Wei Te Chung; Andrew C. Cheng; Ming Chieh Chang

(57) ABSTRACT

A multi-frequency antenna (100) comprises a radiating patch (20) having a first radiating body operating in lower frequency band and a second radiating body operating in higher frequency band; a grounding patch (10) spaced apart from the radiating patch; a connecting element (30) electrically connecting the first radiating body, the second radiating body, and the grounding patch; a feeding line (5) comprising an inner conductor and an outer conductor. The first radiating body comprises a first radiating element and a second radiating element extending from the first radiating element. The second radiating body comprises the first radiating element and a third radiating element extending from the first radiating element. The radiating patch also comprises a fourth radiating element extending from an end of the connecting element and a coupling element extending from the grounding patch. The inner conductor electrically connects to a joint of the fourth radiating element and the connecting element. The outer conductor electrically connects to the grounding patch.

14 Claims, 3 Drawing Sheets

MULTI FREQUENCY ANTENNA WITH LOW PROFILE AND IMPROVED GROUNDING ELEMENT

BACKGROUND OF THE INVENTION

1. Field of the Invention

The present invention relates to an antenna, and more particularly to an multi-frequency antenna having wider range of frequency band.

2. Description of Prior Art

Wireless communication devices, such as cellular phones, notebook computers, electronic appliances, and the like, are normally equipped with an antenna for working in WLAN (Wireless Local Area Network) that serves as a medium for transmission and reception of electromagnetic signals, such as date, audio, image, and so on. However, more and more people dissatisfy their electronic devices only work in WLAN (Wireless Local Area Network). Making the portable electronic devices working in WWAN (Wireless Wide Area Network) or GPS (Global Positioning System) is a purpose of the many people.

In recent years, WLAN adopts two key technical standards of Bluetooth and Wi-Fi. Bluetooth works in 2.4 GHz, and Wi-Fi works in 2.4 GHz and 5 GHz. However, WWAN adopts three technical standards of GSM (Global System for Mobile Communication), GPS (Global Positioning System) and CDMA (Code Division Multiple Access). Operating frequency bands of the GSM are 900/1800 MHz, and operating frequency band of the GPS is 1.575 GHz. CDMA includes three kinds of technical standards: CDMA2000, WCDMA and TD-SCDMA. Operating frequency bands of the CDMA2000 are 800, 900, 1700, 1800, 1900, and 2100 MHz. Operating frequency bands of the WCDMA are 1800, 1900, and 2100 MHz. Operating frequency bands of the TD-SCDMA are 900, 1800, and 2100 MHz.

Taiwanese patent No. 1254493 discloses a multi-band antenna including two radiating elements for working 1800 MHz frequency band and 900 MHz frequency band.

However, the multi-band antenna has narrower range of frequency band, and is not capable to cover all frequency bands of WWAN.

SUMMARY OF THE INVENTION

An object of the present invention is to provide a multi-frequency antenna which has wide range of frequency band.

To achieve the aforementioned object, the present invention provides a multi-frequency antenna comprising: a radiating patch having a first radiating element and a second radiating element; a grounding patch spaced apart from the radiating patch; a connecting element comprising a first connecting arm and a second connecting arm; a feeding line comprising an inner conductor and an outer conductor; wherein the first connecting arm connecting to the radiating patch and the second connecting arm connecting to the grounding patch; the first connecting arm locating in a first plane is perpendicular to the second connecting arm locating in a second plane.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
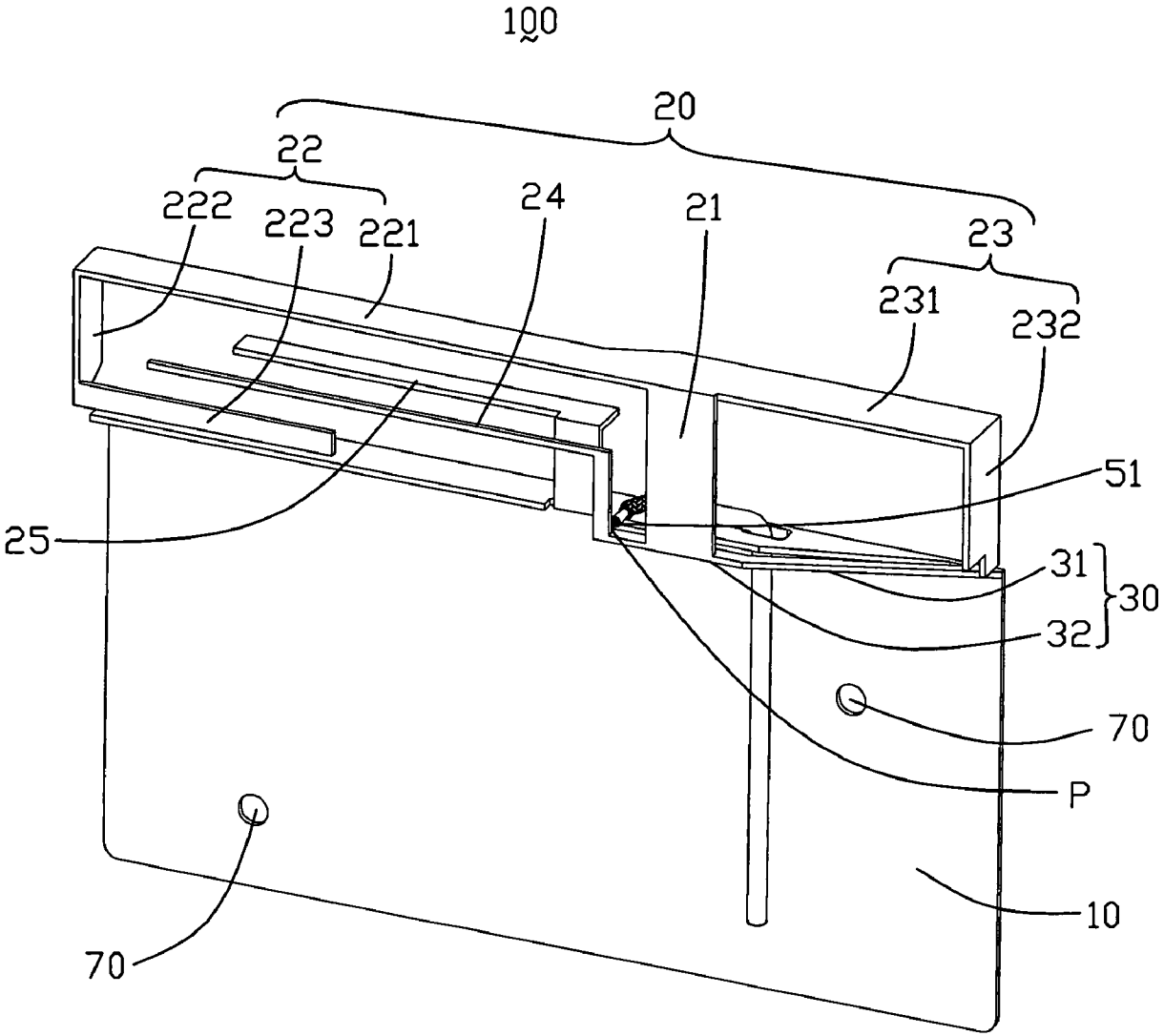
FIG. 1 is a perspective view of a multi-frequency antenna in accordance with a preferred embodiment of the present invention.
Figure 2:
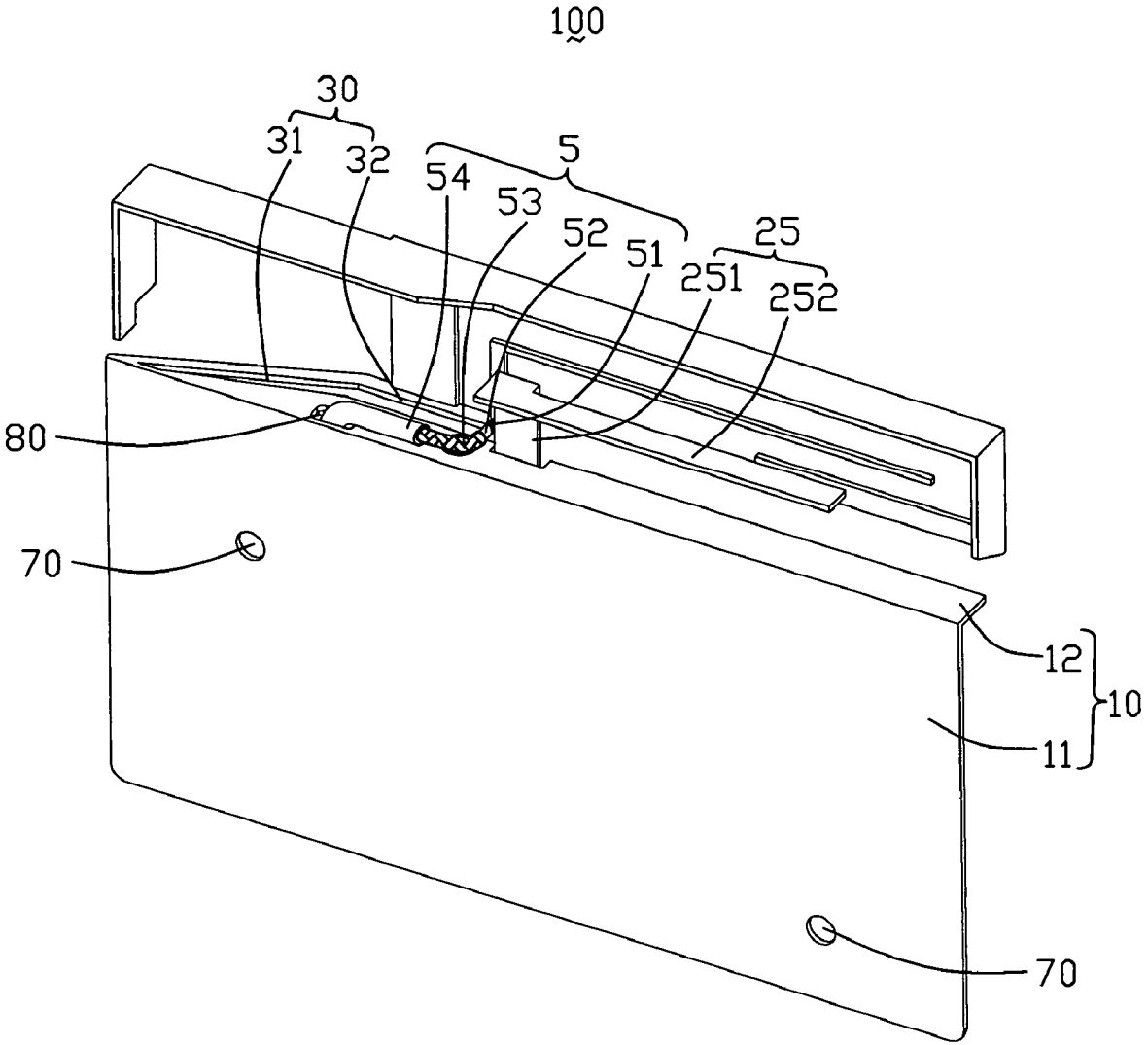
FIG. 2 is a view similar to FIG. 1, but from a different aspect.

Referring to FIGS. 1 and 2, a multi-frequency antenna 100 in accordance with a first embodiment of the present invention comprises a radiating patch 20, a grounding patch 10 spaced apart from the radiating patch 20, a connecting element 30 connecting the radiating patch 20 and the grounding patch 10, a coupling radiating element 25, and a feeding line 5.

The grounding patch 10 comprises a horizontal grounding element 12 and a vertical grounding element 11 perpendicularly connecting to the horizontal grounding element 12. The horizontal grounding element 12 is rectangle and narrow. One tail end of the horizontal grounding element 12 is triangle-shape. The vertical grounding element 11 has two installing hole 70 for a screw (not shown) through to installing the multi-frequency antenna 100 onto a cover of the portable electronic device (not shown). The horizontal grounding element 12 has a through hole 80 for the feeding line 5 through.

The connecting element 30 having triangle-shape comprises a first connecting arm 31 and a second connecting arm 32 extending from an end of the first connecting arm 31. The first connecting arm 31 and the horizontal grounding element 12 form a sharp angle. The first connecting arm 31 and the second connecting arm 32 form an obtuse angle.

The radiating patch 20 comprises a first radiating-element extending from the middle of the second connecting arm 32, a second radiating element 22 and a third radiating element 23 extending from an end of the first radiating element 21 to opposite directions, and a fourth radiating element 24 extending from an end of the second connecting arm 32. The first radiating element 21 has rectangle-shape. The first radiating element 21 is wider than the second radiating element 22, the third radiating element 23, and the fourth radiating element 24. The second radiating element 22 having "U" shape comprises a first radiating branch 221, a second radiating branch 222 extending vertically from an end of the first radiating branch 221, and a third radiating branch 223 extending from an edge of an end of the second radiating branch 222 to the first radiating branch 221. The third radiating element 23 comprises a fourth radiating branch 231 locating in a common beeline with the first radiating branch 221 and a fifth radiating branch 232 extending vertically from an end of the fourth radiating branch 231. The fourth radiating element 24 having "L" shape locates in a common plane with the first radiating element 21. The fourth radiating element 24 comprises a shorter vertical part and a longer horizontal part. The coupling radiating element 25 comprises a first radiating arm 251 extending vertically from the middle of the horizontal grounding element 12 and a second radiating arm 252 extending an end of the first radiating arm 251 and paralleling to the horizontal grounding element 12. The second radiating arm 252 having L-shape is longer than the first radiating arm 251.

The feeding line 50 comprises an inner conductor 51, an inner insulating layer 52, an outer conductor 53 electrically connecting to the horizontal grounding element 12, and an outer insulating layer 54. The inner conductor 51 electrically connects to a joint point P of the fourth radiating element 24 and the connecting element 30.

The first radiating element 21 and the second radiating element 22 form a first radiating body operating in lower frequency band of the WWAN. The first radiating element 21 and the third radiating element 23 form a second radiating body operating in higher frequency band of the WWAN. The length of the fourth radiating element 24 is about equal to the second radiating body. Accordingly, the fourth radiating element 24 is capable to widen the higher frequency band of the WWAN. The length of the coupling radiating element 25 is about equal to the second radiating body. Accordingly, the coupling radiating element 25 is capable to widen the higher frequency band of the WWAN.

The multi-frequency antenna 100 has lower profile because of the connecting element 30 and the horizontal grounding element 12 being coplanar. The connecting element 30 extends from a tip of the triangular end of the grounding element 12, accordingly, the length of the multi-frequency antenna 100 is shorter than traditional antenna. If the connecting element 300 extends from a middle portion of the grounding patch as traditional antenna, the multi-frequency antenna 100 will be prolonged due to the length of the fourth radiating element 24 being changeless.

Figure 3:
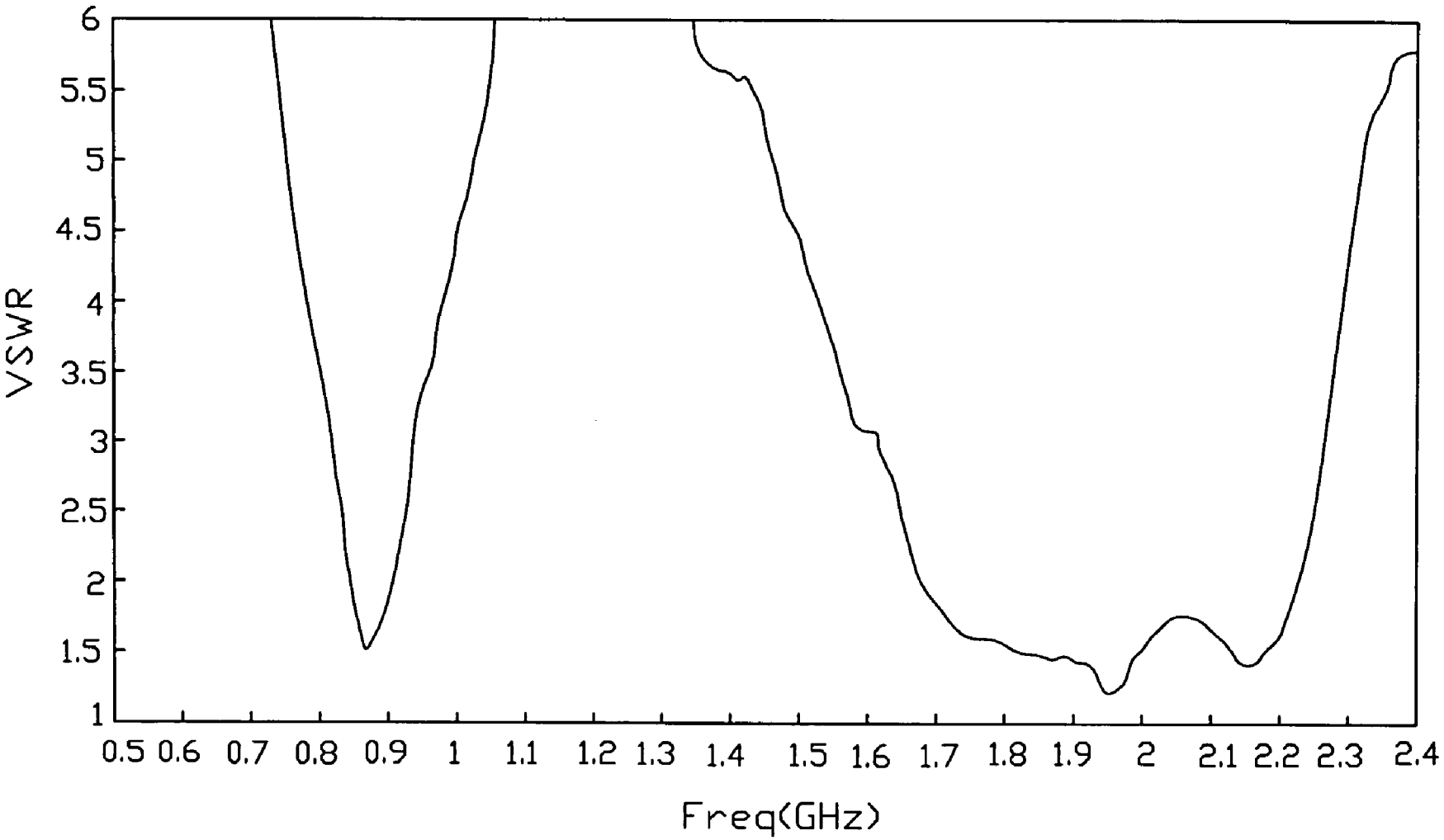
FIG. 3 is a test chart recording for the multi-frequency antenna in accordance with a preferred embodiment of the present invention, showing Voltage Standing Wave Ratio (VSWR) as a function of WWAN frequency.

FIG. 3 is a test chart of Voltage Standing Wave Ratio of the multi-frequency antenna 100. Referring to FIG. 3, operating frequency band of the multi-frequency antenna 100 are 840 MHz-920 MHz and 1680 MHz-2230 MHz. Above-mentioned operating frequency band has covered all of the frequency bands of the WWAN.

What is claimed is:

1. A multi-frequency antenna, comprising:

a radiating patch having a first radiating body operating in a lower frequency band and a second radiating body operating in a higher frequency band;

a grounding patch spaced apart from the radiating patch, and comprising a horizontal grounding element and a vertical grounding element extending from an edge of the horizontal grounding element;

a connecting element electrically connecting the first radiating body and the second radiating body to the grounding patch, the connecting element comprising a first connecting arm and a second connecting arm, and an obtuse angle being formed between the first connecting arm and the second connecting arm;

a feeding line comprising an inner conductor and an outer conductor; wherein the first radiating body comprises a first radiating element and a second radiating element extending from the first radiating element; the second radiating body comprises the first radiating element and a third radiating element extending from the first radiating element; the radiating patch also comprises a fourth radiating element extending from an end of the connecting element and a coupling element extending from the grounding patch; the inner conductor electrically connects to a joint of the fourth radiating element and the connecting element; the outer conductor electrically connects to the grounding patch, said horizontal element has a triangular tail end; the connecting element extends from the triangular tail end, and said first connecting arm and the triangular tail end form an acute angle.

2. The multi-frequency antenna as claimed in claim 1, wherein said horizontal grounding element and the connecting element locate in a common plane and form a gap.

3. The multi-frequency antenna as claimed in claim 1, wherein said grounding patch and the second connecting arm locate in a common plane.

4. The multi-frequency antenna as claimed in claim 1, wherein said second radiating element has U-shape structure and comprises a first radiating branch, a second radiating branch extending vertically from an end of the first radiating branch, and a third radiating branch extending vertically from an end of the second to the first radiating element.

5. A multi-frequency antenna, comprising:

a radiating patch having a first radiating body operating in a lower frequency band and a second radiating body operating in a higher frequency band;

a grounding patch spaced apart from the radiating patch;

a connecting element electrically connecting the first radiating body and the second radiating body to the grounding patch, said connecting element comprises a first connecting arm and a second connecting arm, and an obtuse angle being formed between the first connecting arm and the second connecting arm;

a feeding line comprising an inner conductor and an outer conductor; wherein the first radiating body comprises a first radiating element sharing with the second radiating body and a second radiating element; the second radiating body comprises a third radiating element; the grounding patch comprises a horizontal grounding element and a vertical grounding element extending from an edge of the horizontal grounding element; the horizontal element has a triangular tail end; the connecting element extends from the triangular tail end, said first connecting arm and the triangular tail end form an acute angle.

6. The multi-frequency antenna as claimed in claim 5, wherein said radiating patch also comprises a fourth radiating element extending from an end of the connecting element and a coupling element extending from the grounding patch.

7. The multi-frequency antenna as claimed in claim 5, wherein said the inner conductor electrically connecting to a joint of the fourth radiating element and the connecting element; the outer conductor electrically connects to the grounding patch.

8. The multi-frequency antenna as claimed in claim 5, wherein said horizontal grounding element and the connecting element locate in a common plane and form a gap.

9. The multi-frequency antenna as claimed in claim 5, wherein said second radiating element has U-shape structure and comprises a first radiating branch, a second radiating branch extending vertically from an end of the first radiating branch, and a third radiating branch extending vertically from an end of the second to the first radiating element.

10. A multi-frequency antenna comprising:

a grounding element essentially defining an angled outer edge;

a connection element including a first segment spaced from and essentially parallel to a first corresponding section of said angled outer edge, and a second segment extending in an oblique manner with regard to the first segment and essentially parallel to a second corresponding section of said angled outer edge and having one end linked to said first segment and the other end linked to the grounding element so as to form an angled slender slot between the connection element and the angled outer edge;

a radiating patch having a first radiating element extending from a side edge of the first segment, and a second radiating element extending from the first radiating element; and a feeding line including an inner conductor electrically and mechanically connected to the first segment and an outer conductor electrically and mechanically connected to the grounding element; wherein the first radiating element is angled with regard to both said grounding element and said second radiating element.

11. The assembly as claimed in claim 10, wherein said second radiating element is parallel to said grounding element.

12. The assembly as claimed in claim 11, wherein said grounding element is a horizontal grounding plate.

13. The assembly as claimed in claim 12, wherein said grounding element defines a through hole through which is feeding line extends.

14. The assembly as claimed in claim 12, wherein a coupling element extends from an outer edge of said grounding plate and is closer to the radiating patch under a condition of being smaller than the radiating patch in both vertical and lengthwise dimensions.

* * * * *